United States Patent [19]

Johnson

[11] 4,219,401

[45] Aug. 26, 1980

[54] METAL ELECTROWINNING FEED CATHODE

[75] Inventor: David R. Johnson, Midland, Mich.

[73] Assignee: The D-H Titanium Company, Midland, Mich.

[21] Appl. No.: 931,089

[22] Filed: Aug. 7, 1978

Related U.S. Application Data

[63] Continuation-in-part of Ser. No. 722,851, Sep. 13, 1976, Pat. No. 4,113,584, which is a continuation-in-part of Ser. No. 517,568, Oct. 24, 1974, abandoned.

[51] Int. Cl.[2] ..... C25C 7/02; C25C 3/14

[52] U.S. Cl. ..... 204/284; 204/290 R; 204/245

[58] Field of Search ..... 204/245-247, 204/284, 64 T, 290 R, 112

[56] References Cited

U.S. PATENT DOCUMENTS

| | | | |
|---|---|---|---|
| 2,801,964 | 8/1957 | Opie et al. | 204/246 |
| 2,848,397 | 8/1958 | Reimert et al. | 204/246 X |
| 2,904,477 | 9/1959 | Opie et al. | 204/246 X |
| 2,985,569 | 5/1961 | Gendvil | 204/246 X |
| 3,188,282 | 6/1965 | Freedman | 204/246 X |
| 3,244,605 | 4/1966 | Hotchkiss et al. | 204/112 X |

*Primary Examiner*—John H. Mack
*Assistant Examiner*—D. R. Valentine
*Attorney, Agent, or Firm*—Robert W. Selby

[57] ABSTRACT

Feed cathode for an electrolytic cell with a feed conduit suited to pass a metal compound therethrough from a source to an electrolyte in the cell. The feed cathode includes a member surrounding and substantially entirely enclosing at least an outlet of the conduit. The member is at least partially formed of an electrically conductive foraminous body suited to pass the electrolyte and ions of a multivalent metal compound therethrough. Preferably, the foraminous body has an electrical coefficient of greater than zero to about 1 and a flow coefficient of from about 0.1 to about 300.

16 Claims, 4 Drawing Figures

11
16
17
18
14
13
15
16
12

11a
30
31
28
32
29
22
20
16a
21
25
27
23
26
12a
14a
24

METAL ELECTROWINNING FEED CATHODE

CROSS REFERENCE TO RELATED APPLICATION

This is a continuation-in-part of prior application Ser. No. 722,851, filed Sept. 13, 1976, now U.S. Pat. No. 4,113,584, which is a continuation-in-part of a prior application Ser. No. 517,568, filed Oct. 24, 1974, now abandoned.

BACKGROUND OF THE INVENTION

This invention pertains to the electrowinning of metal and more in particular relates to a means to introduce a feed material into an electrolytic cell for producing a metal from metal ions in a fused salt bath.

Metals, such as titanium, have previously been electrolytically recovered from, for example, titanium tetrachloride in a fused salt bath, such as a mixture of potassium and lithium chlorides, in an electrolytic cell containing an anode, cathode and a means to supply metal ions to the bath. Such processes are generally described in, for example, Leone et al., High-Purity Titanium Electrowon from Titanium Tetrachloride, J. of Metals 18 (March 1967); Leone et al., Use of Composite Diaphragms in the Electrowinning of Titanium, Bureau of Mines Report RI 7648 (1972) and U.S. Pat. Nos. 2,789,943; 2,943,032 and 3,082,159. These processes produce generally satisfactory titanium by, for example, bubbling titanium tetrachloride gas directly into a molten lithium chloride-potassium chloride catholyte, reducing the titanium ion and depositing metallic titanium on the cathode and releasing chlorine at the anode. However, an improved means of introducing or feeding a multivalent metal into a molten salt bath of an electrolytic cell is desired.

SUMMARY OF THE INVENTION

A novel and improved means to introduce an ionizable metal compound into an electrolyte of an electrolytic cell has been developed. Ionizable metals are multivalent metals with at least two valence states. The ionizable metal compound introducing means or feed cathode comprises a feed conduit with at least one inlet and at least one outlet suited to pass a metal compound from a metal compound source into the electrolyte. The feed cathode includes a member surrounding and substantially entirely enclosing at least the outlet of the conduit. The enclosing member is at least partially formed of an electrically conductive foraminous body suited to pass an electrolyte and ions of a multivalent metal compound therethrough.

In operation, the ionizable multivalent metal compound is passed through the conduit and into the electrolyte. Upon entrance into, or mixing with, the electrolyte, the metal compound is believed to be dissociated into ions of the metal compound. The enclosing member preferably confines agitation caused by feeding a gaseous metal compound and/or an inert dispersing gas to within the feed cathode. A power source is electrically connected to at least the foraminous member to apply a sufficient negative charge to the foraminous member to reduce the metal ions from a higher to a lower valence state. Electrolyte containing dissolved ions from the metal compound passes through the foraminous member into a deposition cathode compartment and to the deposition cathode where solid metal is deposited. Generally, the metal ions are believed to be reduced from a higher to a lower valence state within or substantially adjacent to the feed cathode.

BRIEF DESCRIPTION OF THE DRAWING

The accompanying drawing further illustrates the invention.

Identical numerals, distinguished by a letter suffix, within the several figures represent parts having a similar function within the different embodiments.

DESCRIPTION OF THE PREFERRED EMBODIMENTS

Figure 1:
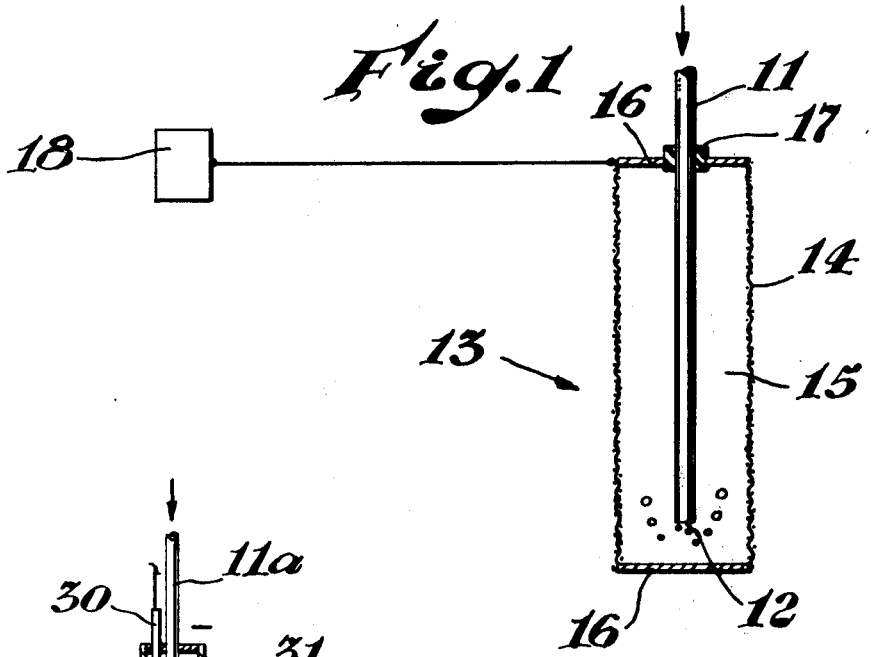
FIG. 1 illustrates one embodiment of the invention.

In FIG. 1 is a metal compound feed cathode adapted to be disposed within an electrolytic cell for the electrodeposition of a metal on a negatively charged cathode. The feed cathode comprises a feed conduit, such as a tube or pipe 11, suited to have an ionizable multivalent metal compound passed therethrough. Examples of suitable multivalent metals are Ti, V, Cr, Mn, Fe, Co, Ni, Y, Zr, Nb, Mo, Ru, Rh, Pd, Te, Os, Ir and Pt. Generally, and preferably, the compound is a halide such as a fluoride, bromide, iodide and most preferably a chloride. Although the hereinafter description refers to the preferred titanium it also applies to the multivalent metals generally.

Surrounding and generally enclosing an opening 12 in the pipe 11 for the egress of a metal compound, such as the preferred titanium tetrachloride ($TiCl_4$), from the pipe 11 into an electrolyte, such as a molten mixture of potassium chloride and lithium chloride, is an enclosing member 13. The enclosing member 13 at least partially includes an electrically conductive foraminous member 14 suited to pass ions from the metal compound in the molten electrolytic bath from within a feed electrode compartment, such as a generally annular opening 15, formed by the exterior of the pipe 11 and the interior of the enclosing member 13, to a catholyte contained in an adjacent deposition cathode compartment (not shown). Substantially gas impervious elements 16 physically join together the upper and lower extremities of the foraminous member 14.

The enclosing member 13 is securely generally coaxially affixed around the pipe 11 by means known to those skilled in the art. An electrical insulating element 17 can optionally be positioned to space apart the pipe 11 from the enclosing member 13 to electrically insulate the pipe 11 from the foraminous member 14 when a negative charge is applied to the foraminous member by means of a negative power source 18 suitably electrically connected thereto.

During operation of the embodiment of FIG. 1, the feed cathode is so positioned within an electrolytic cell (not shown) to extend the electrically charged portion at least partially, and preferably substantially entirely, below the surface of a molten halide electrolyte. An ionizable metal compound, such as titanium tetrachloride, flows or is pumped from a source (not shown) through the conduit 11 and into the feed electrolyte compartment 15 from the opening 12. The negative power source 18 is energized to thereby apply a negative charge and make cathodic the foraminous member 14. The electrically negative foraminous member 14 at least partially reduces the titanium ions within and surrounding the feed cathode from a higher valence to a lower valence.

By the use of the foraminous member 14 having pores of a sufficient size to pass the molten electrolyte without transmission of a substantial amount of physical turbulence from within the annular opening 15 (resulting from, for example, gaseous $TiCl_4$ entering the compartment) into the cathode compartment surrounding the feed cathode, improved utilization of $TiCl_4$ over the prior art processes is realized.

Figure 2:
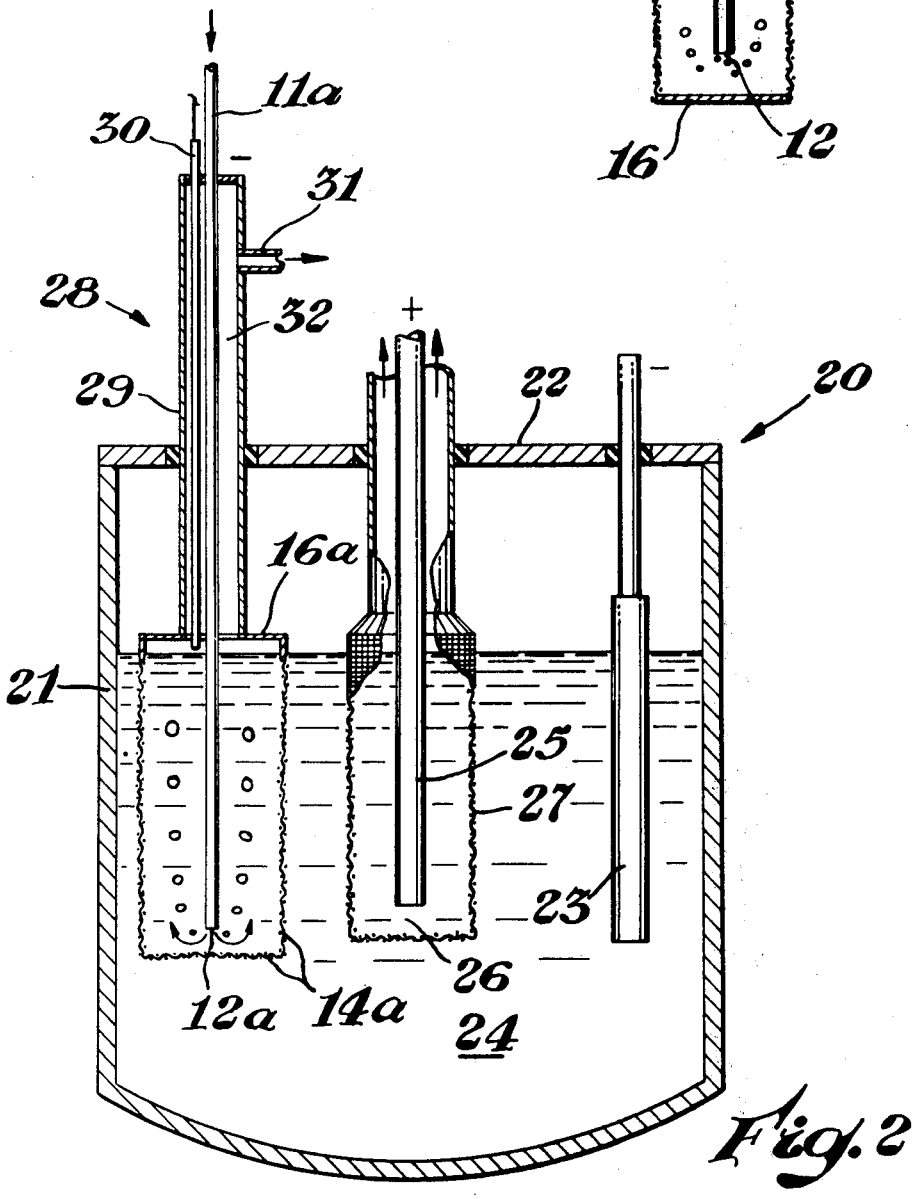
FIG. 2 illustrates another embodiment of the invention in combination with an electrolytic diaphragm cell.

FIG. 2 depicts another embodiment of the invention including an electrolytic cell 20 with a containing means 21 and a cover 22. A metal deposition cathode 23 is disposed within a cathode compartment 24, which is spaced apart from a positive charged anode 25, disposed within an anode compartment 26, by a porous diaphragm 27. A feed cathode 28 is disposed within the electrolytic cell 20 and adapted to be at least partially immersed in the catholyte contained in the cathode compartment 24. The feed cathode 28 includes a feed pipe 11*a* of a suitable material to be immersed in the molten salt catholyte and have $TiCl_4$ passed therethrough. The catholyte is preferably a mixture of molten halides, for example, the chlorides of lithium and potassium. Titanium tetrachloride can flow through the pipe 11*a* simultaneously with an inert gas, such as argon. The inert gas promotes mixing of the $TiCl_4$, or a solid metal compound, in the electrolyte. A foraminous member 14*a* substantially completely surrounds a lower exit 12*a* of the pipe 11*a*. The member 14*a* is physically supported and electrically attached to a support 29, which is optionally generally coaxially spaced apart from the pipe 11*a*.

A heating means, such as an electric heater 30, can optionally be juxtaposed between the pipe 11*a* and the support 29 to heat the gases passing within the support 29 or the pipe 11 and to minimize freezing of the electrolyte adjacent thereto. A gas removal means 31 is provided in the support 29 to permit excess gases, such as argon, which are not dissolved or dissociated in the electrolyte, to pass within an annulus 32 and be vented into an appropriate container (not shown). The support 29 is optionally provided with a substantially gas impervious element 16*a* suited to be at least partially immersed in the electrolyte to prevent excess gas from entering into the atmosphere within the electrolytic cell 20. Desirably substantially all of the member 14*a* is immersed in the electrolyte.

The foraminous member 14*a* is characterized by an electrical coefficient ($C_d$) of greater than zero up to about 1, and preferably within the range of from about 0.1 to about 1, when the coefficient of flow ($C_f$) is within the range of from about 0.1 to about 300. Herein $C_d$ is defined as being in inches and $C_f$ as being in $\sqrt{\text{inches}}$ per liter per minute per 30 square inches of foraminous member surface. The coefficient of the foraminous member is determined by the hereinafter described procedure and is represented by the formula:

$$C_d = \frac{V_{f+s}/I_{f+s} - V_s/I_s}{V_s/I_s} \times 0.75 \text{ where:}$$

"$V_{f+s}$" is the voltage (volts) in an aqueous 0.1 molar sodium chloride solution of a test cell as determined by calomel measuring electrodes communicating with the solution in the test cell by salt bridges with orifices to such salt bridges spaced 0.75 inch apart between silver-silver chloride primary electrodes, spaced one inch apart, and also spaced apart by that portion of the foraminous member positioned between the primary electrodes during operation "$I_{f+s}$" is an electrical current of 0.002 amperes maintained between the primary electrodes in the solution with a foraminous member positioned as for $V_{f+s}$ "$V_s$" is the voltage (volts) as determined for $V_{f+s}$, but without the foraminous member "$I_s$" is an electrical current of 0.002 amperes maintained between the primary electrodes in the solution, as determined for $I_{f+s}$, but without the foraminous member The coefficient of flow is represented by the formula: $C_f = \sqrt{h/F}$ where:

"h" is a pressure head of ten inches of water at about 75° F. as measured upwardly from center line of a circular portion of the foraminous member, with a 30 square inch area on a single surface of such circular portion, where a water flow measurement through the diaphragm is obtained, and "F" is the volumetric water flow rate through the foraminous member in liters per minute at about 75° F.

The configuration or size of the foraminous member may necessitate that a portion of such member smaller or larger than the above 30 square inch portion be used for measuring the water flow. When such a smaller or larger portion is used, F should be calculated to represent the water flow through the 30 square inch area described above.

Stated in a slightly different manner, the above formula for determining the electrical coefficient is believed to be basically the combined resistance of the foraminous member plus the solution in the test cell minus the resistance of the solution divided by the resistance of the solution. The number resulting from this calculation represents the electrical resistance of the foraminous member in terms of the electrical resistance of 0.75 inch of the solution, since the salt bridges are spaced 0.75 inch apart. To convert the calculated number to a term expressed in inches of solution, the calculated number is multiplied by 0.75. The electrical coefficient represents the electrical resistance of the foraminous member in the test cell. The electrical coefficient is also believed to be a measure of the resistance of the solution contained in the pores of the foraminous member.

The foraminous member 14*a* is, for example, a sintered plate, screen, plated screen, sheet or film with a multiplicity of substantially uniform holes or pores extending therethrough. Such pores can be formed by, for example, drilling, punching, weaving, and the like. The foraminous member 14*a* preferably is a woven wire screen, with, for example, a U.S. Standard Screen Mesh of about 50 to about 250 and more preferably about 100 to about 200 on which a sufficient amount of a material, such as, cobalt, iron or nickel has been deposited by electrolytic or electroless procedures to provide a desired $C_d$ and $C_f$. Suitable deposition procedures are those well known in the art adapted to produce a visually dull or rough surface by, for example, using a reduced amount of brighteners in the plating solutions.

For example, satisfactory plating of carbon steel or commercially pure nickel screens with mesh sizes of 100 or 200 has been carried out using the following solutions:

| Electroless Cobalt | grams per liter of final solution |
|---|---|
| Cobalt chloride—$CoCl_2 . 6H_2O$ | 30.0 |
| Sodium citrate—$Na_3C_6H_5O_7 . 2H_2O$ | 35 to 50 |
| Ammonium chloride—$NH_4Cl$ | 50 |
| Sodium hypophosphite—$NaH_2PO_2 . H_2O$ | 20 |
| pH—8 to 9 | |

| Electroless Nickel | | |
|---|---|---|
| basic nickel carbonate - $4NiCO_3 . 3Ni(OH)_2 . 4H_2O$ | 10.00 | |
| citric acid - $C_6H_8O_7$ | 5.25 | |
| ammonium bifluoride - $NH_4HF_2$ | 10.00 | |
| sodium hypophosphite - $NaH_2PO_2 . H_2O$ | 20.00 | |
| hydrofluoric acid - 70 volume % HF solution | 6.0 | milliliters/liter |
| ammonium hydroxide - volume % $NH_4OH$ | 30.0 | " |
| pH - about 6.5 | | |

| Electrolytic Iron | | |
|---|---|---|
| commercial ferrous fluoborate | 77 | volume percent |
| sodium chloride — NaCl | 4.5 | weight percent |
| water | 23 | volume percent |

The substrate of the foraminous member can be a material such as iron including steel and stainless steel; cobalt or nickel or an alloy thereof containing at least about 50 weight percent cobalt or nickel, which is resistant to the environment within the electrolytic cell 20 and retains a desired physical strength at the operating temperatures of the cell 20.

The configuration of the foraminous member 14*a* is of importance in the described apparatus. It is necessary that the pores or openings in the foraminous member 14*a* be large enough to avoid being plugged with, for example, a substantial amount of particulate metallic titanium, other multivalent metal, titanium oxide or sludge therein. Furthermore, the pores should be of a sufficient area to minimize and preferably substantially entirely prevent turbulence within the feed cathode 28 from entering into the cathode compartment 24. Simultaneously, the multiplicity of pores are preferably of a size sufficient to permit passage of a sufficient amount of a preferred lithium chloride-potassium chloride electrolyte from the cathode compartment 24 into the feed cathode 28 to maintain a desired bath level. The plated foraminous member preferably has a $C_d$ of about 0.1 to about 0.6 when the $C_f$ is about 0.1 to about 300. The $C_f$ is preferably about 0.2 to about 30 and more preferably about 0.2 to about 8.

Operation of the feed cathode 28 of FIG. 2 is substantially as described for FIG. 1 with the addition that the electrical power source is suitably electrically connected to the deposition cathode 23 to provide a predetermined negative charge thereon and to the anode 25 to provide a predetermined positive charge thereon. When titanium tetrachloride is fed into the feed cathode 28, metallic titanium is deposited at the deposition cathode 23 and elemental chlorine is released at the anode 25 and flows upwardly to a chlorine container (not shown). Preferably, substantially no metallic titanium will be deposited and retained on the foraminous member 14*a*.

Figure 3:
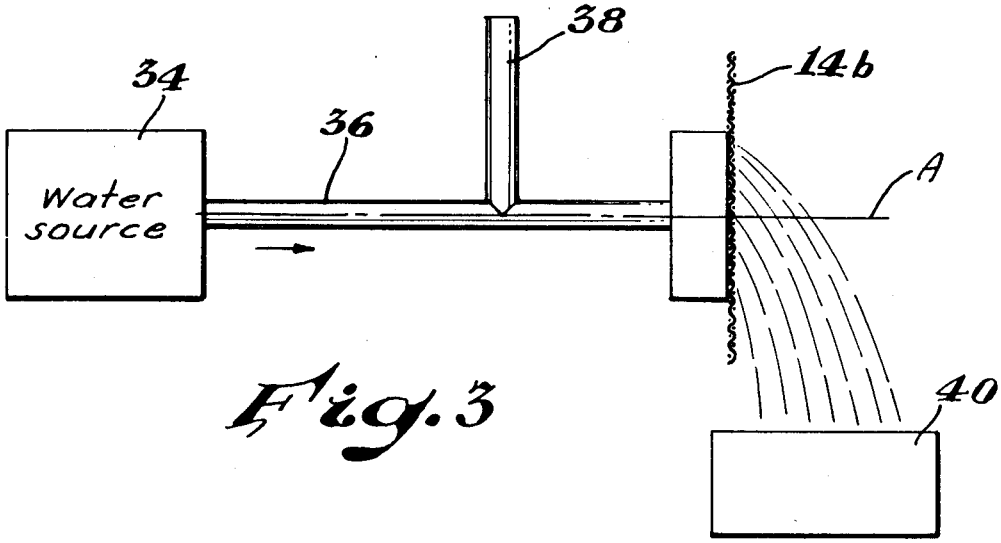
FIG. 3 is a schematic view of a means to measure the water flow rate through a diaphragm.

In FIG. 3 there is schematically depicted a means by which the volumetric flow rate of water through a foraminous member 14*b* is measured. Water maintained at a temperature of about 75° F. is fed from a source 34 to the foraminous member 14*b* through a suitable conduit 36. The water flow rate is sufficient to maintain a water level, or head, in an upwardly extending conduit 38 at a distance of ten inches from axis A of the conduit 36 to the upper surface of the water in the conduit 38. The upper end of the conduit 38 is open to the atmosphere. Maintaining such a head in the conduit 38 insures that the average head over the member 14*b* tested is about 10 inches of water. The volume of water which flows through a 30 square inch portion of the member 14*b* is suitably measured in, for example, a container 40. The measured flow rate in liters per minute is used to determine the flow coefficient, $C_f$.

Figure 4:
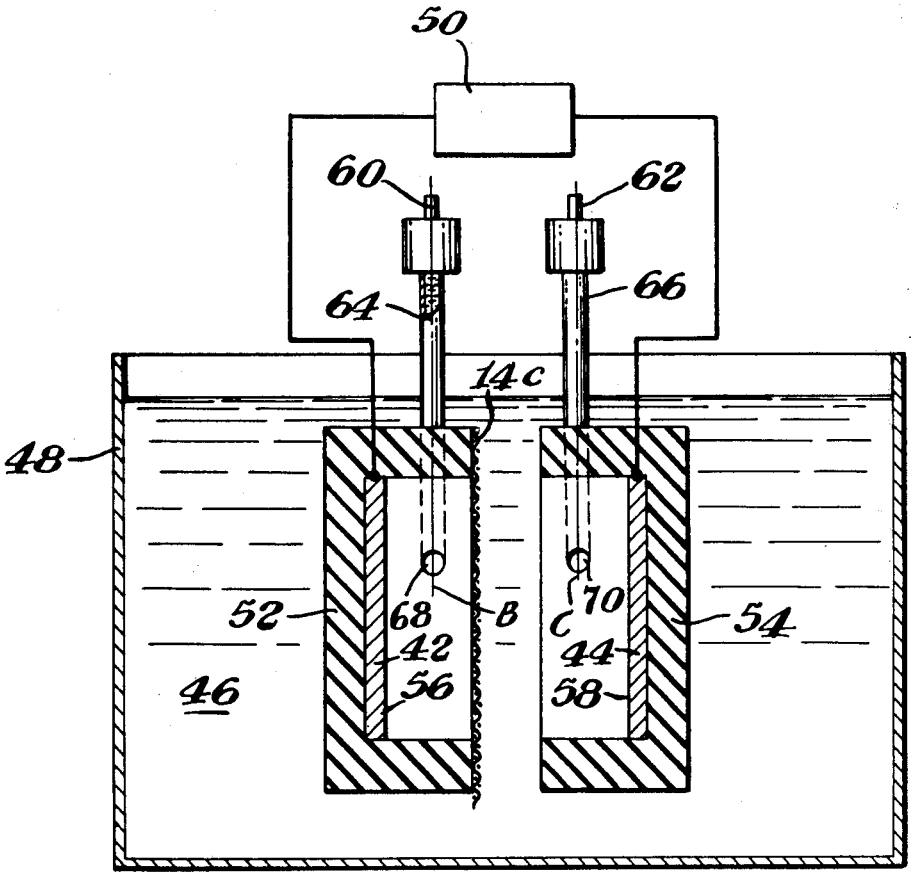
FIG. 4 is a schematic view of an apparatus suitable to measure the electrical coefficient.

Referring now to test apparatus or cell of FIG. 4, $C_d$ is determined by immersing primary electrodes, such as, an anode 42 and a cathode 44, in an electrically conductive solution 46 within a container 48 and connecting such electrodes to a power source 50. Suitable conductive solutions are compatible with the electrodes 42 and 44 and a foraminous member 14*c* and have a sufficient electrical conductivity to afford an accurate determination of the electrical effect of insertion of the member 14*c* into the solution. The electrodes 42 and 44 and the conductive solution are selected to form a cell capable of a reversible electrolytic reaction. Also, the conductivity of the solution is such that insertion of the member 14*c* into the solution between the electrodes 42 and 44 will produce an insufficient voltage change between such electrodes to cause the metallic member 14*c* to become a bipolar electrode. Silver-silver chloride electrodes have proven to be suitable for use as the electrodes 42 and 44 and are used herein in determining the $C_d$. Likewise, an aqueous 0.1 molar sodium chloride solution is suitable for the described $C_d$ determination and is used herein.

In practice, $1\frac{1}{4}$ inch by $\frac{1}{2}$ inch by 1/16 inch thick silver-silver chloride electrodes 42 and 44 are suitably positioned within substantially electrically nonconductive retaining members 52 and 54 to space surface 56 of the electrode 42 about one inch apart from surface 58 of the electrode 44. The retaining members 52 and 54 can be constructed from, for example, a methyl acrylate plastic and adapted to direct substantially all of the electrical current passing between the electrodes 42 and 44 through the member 14*c* when such member is abuttingly detachably attached to the retaining members.

The voltage in the solution 46 is measured by using two auxiliary calomel measuring electrodes 60 and 62 connected to the retaining members 52 and 54 of the test cell by salt bridges 64 and 66. Orifices 68 and 70 of the salt bridges 64 and 66, respectively, pass through the retaining members 52 and 54 at a position between the primary electrodes 42 and 44. The orifices 68 and 70 are suitably positioned to have a distance of $\frac{3}{4}$ inch between the centers of such orifices as represented by center lines B and C.

The resistance of the solution 46 is determined by first impressing a sufficient voltage (direct current) between the primary electrodes 42 and 44 to produce a 0.002 ampere current flow between such primary electrodes. This voltage will be less than that voltage necessary to cause decomposition of the electrolyte solution 46. The voltage drop through the $\frac{3}{4}$ inch distance between the orifices 68 and 70 is measured by the calomel electrodes 60 and 62. The resistance of the solution is determined by dividing the measured voltage between the calomel electrodes 60 and 62 by 0.002 amperes.

The foraminous member 14c is placed in the solution 46 between the primary electrodes 42 and 44 and the salt bridge orifices 68 and 70 to thereby alter the electrical resistance between the electrodes. As aforementioned, the member 14c is placed in contact with the retaining member 52 in a manner suited to maximize the flow of current through the foraminous member and to minimize the passage of current through any openings at the interface between the surface of the retaining member 52 and the foraminous member 14c.

The foraminous member 14c is positioned in the solution 46 between the primary electrodes 42 and 44 and the orifices 68 and 70 to the calomel electrodes 60 and 62 to thereby alter the electrical resistance between the calomel electrodes. At a uniform current of 0.002 amperes, the change in voltage between the calomel electrodes 60 and 62, resulting from insertion of the foraminous member 14c in the test cell, is an amount representative of the porosity and surface characteristics or effectiveness of the foraminous member in the present invention.

The voltage change measured by the calomel electrodes after insertion of the foraminous member between the primary electrodes can readily be converted to an equivalent increase in inches of solution. The equivalent increase in inches of solution is herein referred to as the electrical coefficient.

The above described test was used to determine the suitability of an about two inch diameter by about five inch long cylindrical cobalt plated, woven nickel screen for use as an electrolytic cell feed cathode. The test apparatus contained a 0.1 molar sodium chloride aqueous electrolyte (reagent grade sodium chloride with a purity of 99.5 weight percent dissolved in distilled water), two $1\frac{1}{4}$ inch by $\frac{1}{2}$ inch by 1/16 inch thick rectangular silver-silver chloride primary electrodes spaced about one inch apart, and two standard calomel electrodes suitably physically connected between the primary electrodes by salt bridges to afford measurement of a voltage impressed across a $\frac{3}{4}$ inch distance of sodium chloride solution. The silver-silver chloride electrodes were suitably mounted in an organic plastic frame adapted to permit insertion of the screen foraminous member between the electrodes. An electric potential was impressed across the primary electrodes and the voltage and direct current measured before and after positioning the foraminous member between the electrodes. Tests were carried out at a substantially constant temperature and atmospheric pressure. The voltage of the sodium chloride electrolyte was determined to be 63 millivolts and the current to be two milliamps before insertion of the foraminous member. The voltage increased to 84 millivolts after the foraminous member was inserted into the test cell; the current was maintained at two milliamps. The increase in voltage of 21 millivolts was calculated by standard methods to be equivalent to an increase in test cell resistance of 10.5 ohms or 0.250 inch of electrolyte.

The following examples further illustrate the invention:

EXAMPLES 1–7

Metallic titanium with a purity of about 99.9 weight percent was produced from $TiCl_4$ in a low carbon steel electrolytic cell with a feed cathode similar to that depicted in FIG. 1 and an anode spaced apart from a cathode by a diaphragm. The electrolytic equipment included a substantially cylindrically shaped containing means with an outside diameter of 18 inches and a height of 22 inches. A 1.9 inch diameter by 6.5 inch long substantially cylindrical diaphragm with an enclosed lower end was substantially uniformly positioned around a 0.75 inch diameter by about 18 inch long solid graphite anode. A six inch length of the anode was immersed in a molten lithium chloride-potassium chloride bath having approximately a eutectic composition. The foraminous members were 100 mesh woven screen of either an iron alloy or commercially pure nickel, which had been electrolytically or electrolessly plated with a sufficient amount of cobalt, iron or nickel to provide the $C_d$ and $C_f$ listed in Table I.

Operation of the electrolytic cell of Examples 1–7 impressing an electric potential on the anode and the cathode produced a satisfactory metallic titanium product using feed cathodes with woven screen foraminous members with the characteristics shown in Table I. Titanium tetrachloride was continuously pumped into the feed cathode where it ionized and thereafter passed into the cathode compartment through a multiplicity of pores in the woven screen foraminous member of the feed cathode. Turbulence within the feed cathode, caused by the $TiCl_4$ entering the electrolyte, was satisfactorily retained within the feed cathode. The chlorine produced at the anode and titanium at the cathode were suitably removed from the cell.

TABLE I

| Example | $C_d$ | $C_f$ | Screen Substrate | Coating Procedure | Coating Material |
|---|---|---|---|---|---|
| 1 | 0.222 | 0.216 | iron | electrolytic | iron |
| 2 | 0.281 | 0.232 | " | " | " |
| 3 | — | 0.175 | nickel | " | nickel |
| 4 | 0.581 | 0.699 | " | " | cobalt |
| 5 | 0.359 | 0.771 | " | electroless | nickel |
| 6 | 0.296 | 0.498 | " | " | cobalt |
| 7 | 0.324 | 8.43 | " | " | " |

I claim:

1. A feed cathode for an electrolytic cell comprising a multivalent metal compound feed conduit with at least one outlet suited to pass a metal compound therethrough from a metal compound source to an electrolyte in the electrolytic cell, a member surrounding and substantially entirely enclosing at least the outlet of said conduit, said member being at least partially formed of an electrically conductive foraminous body suited to pass ions of the multivalent metal compound and electrolyte therethrough, with at least the surface of the foraminous body consisting essentially of cobalt.

2. The cathode of claim 1 wherein the foraminous body is a screen having a U.S. Standard Screen Mesh designation of from about 50 to about 250 on which a sufficient amount of a metal has been deposited by electrolytic or electrolysis procedures to provide the desired electrical coefficient and flow coefficient.

3. The cathode of claim 1 wherein at least the surface of the foraminous body consists essentially of cobalt electrolessly deposited from a hypophosphite containing solution.

4. The cathode of claim 1 wherein the foraminous body has an electrical coefficient of greater than zero up to about 1 and a flow coefficient within the range of from about 0.1 to about 300.

5. The cathode of claim 4 wherein the surface of the foraminous body includes a metal coating consisting essentially of cobalt.

6. The cathode of claim 4 wherein the electrical coefficient is within the range of from about 0.1 to about 1.

7. The cathode of claim 4 wherein the electrical coefficient is within the range of from about 0.1 to about 0.6.

8. The cathode of claim 4 wherein the flow coefficient is within the range of from about 0.2 to about 30.

9. The cathode of claim 8 wherein the electrical coefficient is within the range of from about 0.1 to about 0.6.

10. The cathode of claim 4 wherein the flow coefficient is within the range of from about 0.2 to about 8.

11. The cathode of claim 10 wherein the electrical coefficient is within the range of from about 0.1 to about 0.6.

12. The cathode of claim 11 wherein the body includes a nickel screen as a substrate and cobalt plate thereon.

13. The cathode of claim 4 wherein at least the surface of the foraminous body consists essentially of cobalt electrolessly deposited from a hypophosphite containing solution.

14. A feed cathode for an electrolytic cell comprising a multivalent metal compound feed conduit with at least one outlet suited to pass a metal compound therethrough from a metal compound source to an electrolyte in the electrolytic cell, a member surrounding and substantially entirely enclosing at least the outlet of said conduit, said member being at least partially formed of an electrically conductive foraminous body suited to pass ions of the multivalent metal compound and electrolyte therethrough, with the foraminous body including a nickel screen as a substrate with a cobalt plate thereon.

15. The cathode of claim 14 wherein the foraminous body has an electrical coefficient of greater than zero up to about 1 and a flow coefficient within the range of from about 0.1 to about 300.

16. The cathode of claim 15 wherein the electrical coefficient is within the range of from about 0.1 to about 1 and the flow coefficient is within the range of from about 0.2 to about 30.

* * * * *